US007325754B2

(12) United States Patent
Mukai

(10) Patent No.: US 7,325,754 B2
(45) Date of Patent: Feb. 5, 2008

(54) SHOWER NOZZLE

(75) Inventor: Kazuyo Mukai, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 327 days.

(21) Appl. No.: 10/528,478

(22) PCT Filed: Mar. 7, 2003

(86) PCT No.: PCT/JP03/02706

§ 371 (c)(1),
(2), (4) Date: Mar. 18, 2005

(87) PCT Pub. No.: WO2004/026484

PCT Pub. Date: Apr. 1, 2004

(65) Prior Publication Data

US 2005/0284962 A1 Dec. 29, 2005

(30) Foreign Application Priority Data

Sep. 20, 2002 (JP) ..... 2002-276082

(51) Int. Cl.
*B05B 1/30* (2006.01)
*A62C 31/00* (2006.01)

(52) U.S. Cl. ..... 239/583; 239/436; 239/443; 239/437; 239/569

(58) Field of Classification Search ..... 239/436, 239/443, 569, 583, 237; 251/339, 207; 47/48.5
See application file for complete search history.

(56) References Cited

U.S. PATENT DOCUMENTS 4,193,553 A * 3/1980 Kelly et al. ..... 239/586
5,109,553 A * 5/1992 Kishimoto ..... 4/518
5,199,639 A * 4/1993 Kobayashi et al. ..... 239/11
5,433,383 A * 7/1995 Sundholm ..... 239/383
5,735,467 A * 4/1998 Lee ..... 239/414
6,059,200 A * 5/2000 Chou ..... 239/124
6,145,757 A * 11/2000 Knapp ..... 239/443
6,622,945 B1 * 9/2003 Wu et al. ..... 239/443
6,738,996 B1 * 5/2004 Malek et al. ..... 4/677

FOREIGN PATENT DOCUMENTS

| | | |
|---|---|---|
| JP | 62-174653 | 11/1987 |
| JP | 5-9659 | 2/1993 |
| JP | 2000-282526 | 10/2000 |
| JP | 2001-245810 | 9/2001 |
| JP | 2002-153776 | 5/2002 |

* cited by examiner

*Primary Examiner*—Kevin Shaver
*Assistant Examiner*—James S. Hogan
(74) *Attorney, Agent, or Firm*—Jordan and Hamburg LLP

(57) ABSTRACT

In a shower nozzle of the present invention, a holding portion (1*a*) having a water flow passage communicating with a hot/cold water inlet formed therein and a water spraying portion (1*b*) having a plurality of water passing holes provided therein are connected to each other through an open/close valve (6) detachably disposed at one end portion of the holding portion (1*a*) or the water spraying portion (1*b*) to form a nozzle body (1*c*) and a push button (12) for performing the open/close operation of the open/close valve is detachably fitted to the other end of the water spraying portion (1*b*), whereby water can be jetted and stopped by merely pressing the push button from above in a state of the shower nozzle locked to a shower hook to increase an operability, and the shower nozzle can be easily converted into a type not having a water jetting and stopping function or a type having the water jetting and stopping function.

12 Claims, 12 Drawing Sheets

(a)

(b)

SHOWER NOZZLE

TECHNICAL FIELD

The present invention relates to a shower nozzle which is used as a bathtub spout and, to be more specific a shower nozzle which is provided with a push button which performs water jetting and water stopping.

BACKGROUND ART

Conventionally, with respect to this type of a shower nozzle, there has been known a shower nozzle having the constitution shown in FIG. 14 (for example, see, TOTO General Catalogue 2002 to 2003 version, p.678). In this type of shower nozzle, as shown in the drawing, the shower nozzle has a curved shape as a whole and a water spraying portion 100 is formed on a distal end side of the shower nozzle which forms a water flow portion 200 therein and, a holding portion 110 is contiguously joined to the water spraying portion 100. Further, a push button 120 which performs water jetting and water stopping is formed on a side surface of the holding portion 110.

Further, an open/close valve (not shown in the drawing) is arranged in the water flow portion 200 and a user, in a state that he/she holds the holding portion 110, manipulates the push button 120 with a thumb of his/her hand which holds the holding portion 110.

However, from a viewpoint of the manufacturability, the shower nozzle on which the above-described conventional push button 120 is mounted has following drawbacks.

That is, since the push button 120 is arranged on a side surface of the holding portion 110, the manipulating direction of the push button 120 assumes an approximately vertical direction with respect to the water flow portion 200, the open/close direction of the open/close valve assumes an approximately vertical position with respect to the water flow portion 200. Accordingly, to define the water flow portion 200 through the open/close valve and, at the same time, to perform the water jetting and water stopping by opening and closing the open/close valve, the water flow portion 200 eventually has a complicated shape.

Further, from a viewpoint of assembling property, the conventional shower nozzle has a following drawback. The holding portion 110 has a curved shape for facilitating the holding of the shower nozzle. Further, to allow a user to push a push button 120 with his/her thumb in a state that the user uses the shower nozzle with his/her hand, the open/close valve and the push button 120 are arranged on a side surface of the curved holding portion 110. Accordingly, the shower nozzle is assembled such that, the curved holding portion 110 is split in two, the open/close valve and the push button 120 are incorporated into one split holding portion 110, and this one holding portion 110 is covered with another split holding portion 110, and joining portions are welded to each other. Accordingly, it is not easy to incorporate the push button 120 in the shower nozzle on a user side. In view of the above, when a user who purchases a shower nozzle which has no push button 120 wants to add a function of jetting and stopping water on a proximal end of the shower nozzle, it is necessary to newly purchase a shower nozzle per se which has such a function.

Further, the conventional shower nozzle has a following drawback from a view point of the easy-to-use property of the shower nozzle.

As mentioned previously, the push button 120 is arranged on the side surface of the holding portion 110 to facilitate the manipulation of the push button 120 with the thumb when the user holds the shower nozzle and hence, when the user uses the shower nozzle in a state that the shower nozzle is hung on a shower hook, for example, to manipulate the push button 120, it is necessary to push the push button 120 from the front.

However, since the shower nozzle is curved as mentioned previously, the push button 120 is not always directed frontwardly and even when the push button 120 is directed frontwardly in a state that the shower nozzle is hooked on the shower hook, the manipulation performance is extremely poor when the push button 120 is pushed.

Further, the push button 120 is provided for opening and closing the open/close valve arranged in the water flow portion 200 and hence, the push button 120 cannot control a water amount jetted from the shower nozzle. Accordingly, it is necessary for the user to adjust a flow rate by separately manipulating a flow rate adjusting function of the spout which supplies hot and cold water to the shower nozzle.

On the other hand, to enhance the erosion resistance of the appearance of the shower nozzle and, at the same time, to improve the design by enhancing the aesthetic appearance, so as to create the high quality feeling, there may be a case in which the surface treatment such as rating or coating is applied to the shower nozzle (see, for example, TOTO General Catalogue 2002 to 2003 version, p702). In such a shower nozzle, to cope with a case in which the user drops the shower nozzle by accident, a film thickness of the surface treatment is increased to make the peeling-off of the surface treatment such as the plating difficult thus enhancing the durability.

However, to consider the shower nozzle to which the surface treatment is applied, when the film thickness of the plating or the like is increased as mentioned previously, the greater the film thickness becomes, it is more difficult to form the uniform film thickness over the whole shower nozzle and hence, the irregularities are liable to be easily generated. Accordingly, to form the uniform large film thickness, there also arises a drawback that an expense required for the surface treatment is pushed up and a cost of parts is increased.

Further, as shown in FIG. 14, for example, when the plating is directly applied to the shower nozzle which is integrally formed with the water flow portion 200, the plating treatment is also applied to the water flow portion 200. In such a case, when the shower nozzle is used for a long period, the plating on the water flow portion 200 is peeled off and plating pieces may be mixed into the flowing water and hence, it is necessary to prevent the treatment such as the plating from being applied to the water flow portion 200.

Accordingly, to prevent the surface treatment such as the plating from being applied to the water flow portion 200, it is necessary to perform the masking of the water flow portion 200 or an operation to perform the surface treatment such as plating temporarily and, thereafter, to peel off portions of the water flow portion 200 to which the surface treatment such as the plating is applied. Such an operation has a drawback that a cost necessary for performing the surface treatment is pushed up.

DISCLOSURE OF THE INVENTION (1) To overcome the drawbacks, the present invention is directed to a shower nozzle, wherein a holding portion having a water flow passage communicating with a hot/cold water inlet formed therein and a water spraying portion having a plurality of water passing holes provided therein are connected to each other through an open/close valve detachably disposed at one end portion of the holding portion or the water spraying portion to form a nozzle body, a push button is mounted on the other end of the water spraying portion, a shaft which performs the open/close operation of the open/close valve in an interlocking manner with the push button is arranged in the inside of the water spraying portion and, the shaft is vertically movable in an interlocking manner with the vertical movement generated by pushing the push button and with the rotational movement which is generated by the rotation of the push button, whereby a degree of opening of the open/close valve is adjustable.

Due to such a constitution, the direction that the push button is pushed and the direction that the open/close valve is opened become coaxial and hence, the shaft which transmits the manipulation of the push button to the open/close valve can be formed in a straight rod shape and can be arranged on a straight line whereby the structure becomes simple and the manipulation can be performed surely. Further, it is possible to push down the shaft by pushing the push button so as to bring the open/close valve into the open state. Then, by pushing the push button again, the push-down force generated by the shaft is released to bring the open/close valve into the closed state.

Further, by rotating the push button, the shaft is rotated in an interlocking manner with the push button and the shaft. is advanced or retracted in the axial direction in an interlocking manner with the rotational movement. Accordingly, it is possible to change the distance that the shaft pushes the open/close valve. That is, it is possible to change the area of water flow opening by changing the distance that the valve element is separated from the valve seat and hence, it is possible to perform not only water jetting and water stopping but also the flow rate adjustment by manipulating the push button. In this manner, by providing the flow rate adjusting function to the shower nozzle, it is possible to enhance the easy-to-use property or the availability of the shower nozzle.

Further, in the state that the shower nozzle is engaged with the shower hook, the push button is arranged on the upper end portion of the shower nozzle and hence, it is possible to perform water jetting and water stopping by merely pushing the push button which is positioned on the upper end portion from above. Accordingly, the manipulation of the push button is facilitated even in the state that the shower nozzle is engaged with the shower hook.

Further, compared to the conventional shower nozzle which allows the manipulation of the push button only with the thumb, according to the shower nozzle of the present invention, the user can perform the open/close operation of the push button by pushing the push button to any parts of his/her body or an object in the vicinity of the shower nozzle and hence, the manipulation method is broadened.

(2) According to another aspect of the invention described, the push button and the open/close valve are detachably mounted.

Due to such a constitution, in the shower nozzle of the invention, it is possible to select the mounting of the open/close valve and the push button depending on the necessity.

(3) According to another aspect of the invention, an upper cap is detachably mounted on the other end portion of the water spraying portion, and either one of the mounting of the open/close valve and the push button and the mounting of the upper cap is selectable.

Due to such a constitution, it is possible to constitute two kinds of shower nozzles having different functions using all common parts and hence, it is possible to provide the shower nozzle at a low cost. Further, to consider the convenience of a user, even when he/she uses the shower nozzle having neither the open/close valve nor the push button, the user can easily mount the open/close valve and the push button later. Alternatively, as an opposite case, the user can easily convert the shower nozzle provided with the push button which manipulates the open/close valve into the shower nozzle having neither the open/close valve nor the push button.

When the open/close valve and the push button are mounted, in a state that the shower nozzle is engaged with the shower hook, the push button is positioned on the upper end portion of the shower nozzle and the user can perform water jetting and water stopping by merely pushing the push button positioned on the upper end portion from above. Accordingly, the push button can be easily manipulated even in the state that the shower nozzle is engaged with the shower hook. Further, compared to a conventional shower nozzle which allows the manipulation of the push button only with a thumb, in the shower nozzle of the present invention, it is possible to open or close the push button by merely pushing the push button to any part of a human body or an object arranged around the shower nozzle thus broadening a manipulating method.

(4) According to another aspect of the invention, an upper end portion of the shaft and a lower end portion of the push button are threadedly engaged with each other.

Due to such a constitution, it is possible to obtain the substantially equal manner of operation and advantageous effects as the shower nozzles described hereinabove and, at the same time, it is possible to simplify the constitution more.

(5) According to another aspect of the invention, the shaft is constituted of an tipper shaft which is arranged on the push button side and a lower shaft which is arranged on the open/close valve side and, at the same time, end portions of the upper shaft and lower shaft are threadedly engaged with each other.

Due to such a constitution, it is possible to obtain the substantially equal manner of operation and advantageous effects as the shower nozzle described under (3) hereinabove and, at the same time, it is possible to provide the extremely simple constitution to the shower nozzle.

(6) According to another aspect of the invention, a portion of the above described nozzle body except for at least the water passing holes is covered with a detachable cover to which the surface treatment is applied and which also constitutes a separate body.

Due to such a constitution, in the shower nozzles described hereinabove, the erosion resistance of the appearance is enhanced. Further, in performing the surface treatment such as, for example, plating aiming at the enhancement of the aesthetic appearance, by covering the nozzle body with the cover to which the surface treatment is applied and constitutes the separate body, it is no more necessary to perform masking of the water flow passage and peeling-off of the plating of the water flow portion after the whole surface treatment which are performed conventionally whereby the cost can be lowered. Further, it is possible to use covers of various surface treatments by exchanging their combination depending on a user's taste. Further, by constituting the holding portion which forms the water flow passage and the cover as separate bodies from each other, there is no possibility of the occurrence of cracks attributed to the thermal expansion and, at the same time, an air layer is formed between the cover and the holding portion thus providing a heat insulation effect.

(7) According to another aspect of the invention, an upper ring having a diameter larger than an outer diameter of the nozzle body portion is mounted on a distal end portion of the water spraying portion described hereinabove.

Due to such a constitution, in the shower nozzle described hereinabove, even when the shower nozzle falls, it is possible to absorb an impact using the upper ring and hence, there is no possibility that the nozzle body directly comes into contact with a flow surface at the time the nozzle body falls. Accordingly, the nozzle body is hardly injured and hence, even when the surface treatment such as plating or coating, for example, is applied to the nozzle body portion, there is no possibility that the surface treatment is damaged and the plating is peeled off.

(8) According to another aspect of the invention, the nozzle body described hereinabove is formed in an approximately cylindrical rod shape, a lower ring is mounted on a lower portion of the nozzle body, and the cover is arranged inside a line which connects an outer periphery of the uppering and an outer periphery of the lower ring.

Due to such a constitution, in the shower nozzle described hereinabove, when the shower nozzle falls or is dragged on a flow surface, there is no possibility that the shower nozzle body directly comes into contact with the flow surface and hence, there is no fear that the shower body is damaged. Further, even when the surface treatment such as plating or coating is applied to the shower body, there is no possibility that the surface treatment is damaged and hence, there is no fear that a user is injured due to the peeling-off of the plating thus ensuring the safety. Further, since there is no possibility that the surface-treatment-applied portion is damaged, it is no more necessary to particularly increase a film thickness of plating, for example and hence, a weight of a product can be reduced and, at the same time, it is possible to manufacture at a low cost.

(9) According to another aspect of the invention, with respect to the plurality of water passing holes formed in the water spraying portion described hereinabove, the water passing holes which are positioned at an uppermost portion and a lowermost portion of the water spraying portion are formed to have a diameter larger than a diameter of other water passing holes.

Due to such a constitution, in a shower nozzle described hereinabove, it is possible to facilitate withdrawal of staying water in the inside of the water spraying portion and hence, when the shower nozzle is engaged with a shower hook, it is possible to prevent the staying water from dropping continuously drop by drop.

(10) According to another aspect of the invention described, in the inside of the water spraying portion described hereinabove, a volume reducing unit which reduces a volume which allows the staying water communicating with water spraying holes when the shower nozzle is arranged vertically to be dwelled is arranged.

Due to such a constitution, in shower nozzles described hereinabove, it is possible to facilitate the withdrawal of the staying water in the inside of the water spraying portion and hence, when the shower nozzle is engaged with the shower hook in a vertical state, it is possible to effectively prevent the staying water from dropping continuously drop by drop.

BEST MODE FOR CARRYING OUT THE INVENTION

Figure 1:
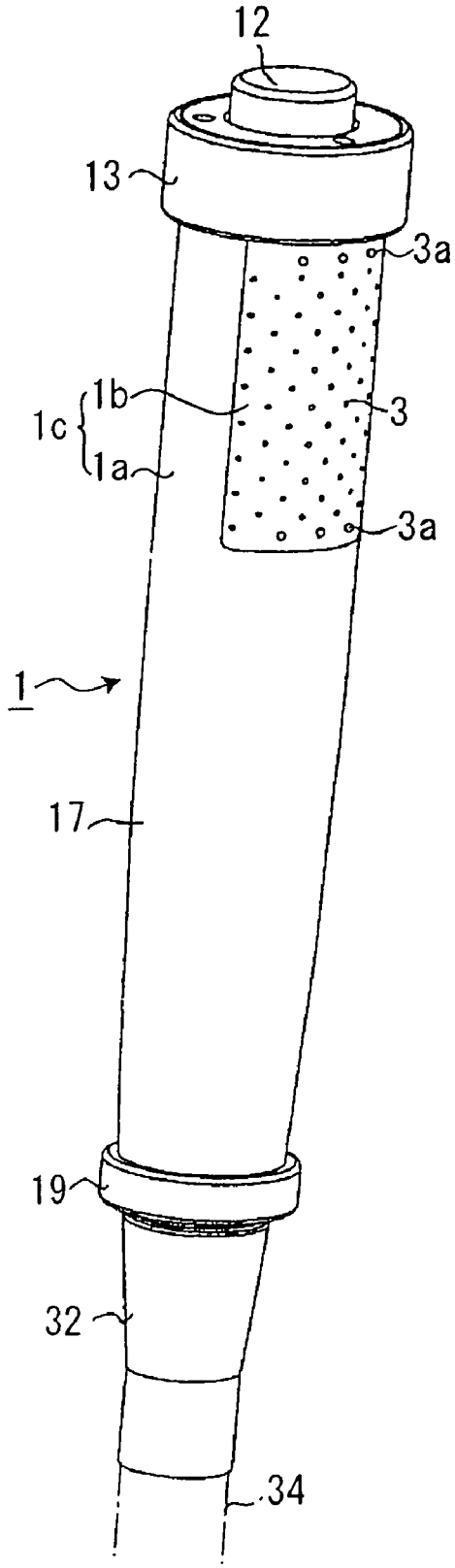
FIG. 1 is a perspective view showing the appearance of a shower nozzle according to an embodiment of the present invention.
Figure 2:
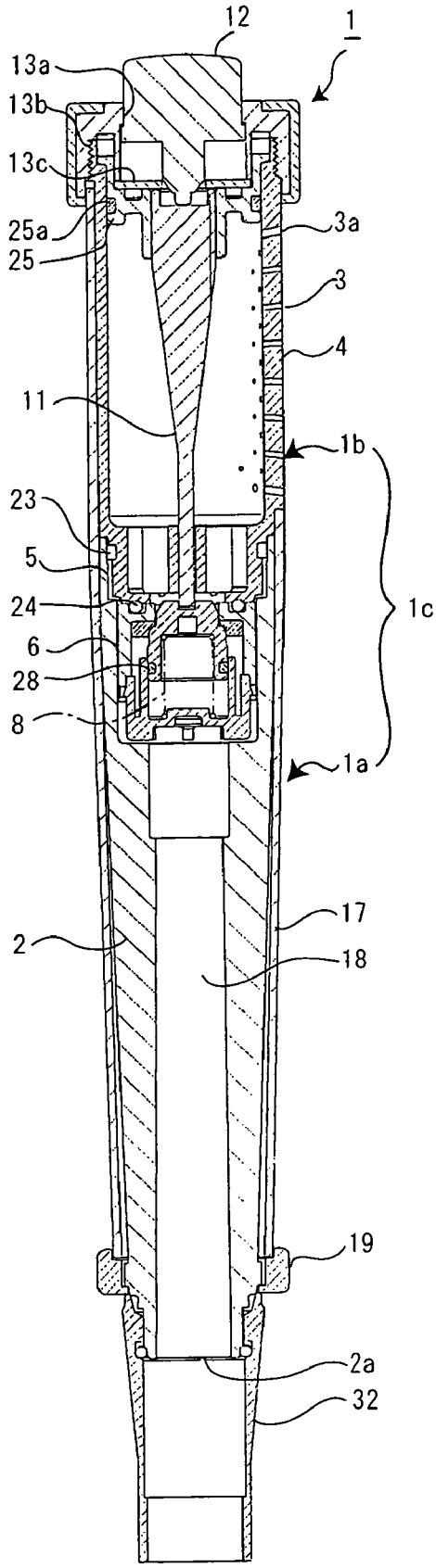
FIG. 2 is a cross-sectional view in the longitudinal direction of the shower nozzle according to the embodiment of the present invention.

A shower nozzle 1 according to the present invention, as shown in FIG. 1 and FIG. 2, includes a shower head body 2 which is provided with a hot/cold water inlet 2*a* and a water flow passage 18 which is communicated with the hot/cold water inlet 2*a* and constitutes a holding portion 1*a*, a spraying pipe 4 which is communicated with the water flow passage 18 of the holding portion 1*a* (the shower head body 2) and constitutes a water spraying portion 1*b* which forms a plurality of water passing holes 3 on a side surface thereof, an open/close valve which is provided between the holding portion 1*a* and the water spraying portion 1*b*, that is, between the shower head body 2 and the water spraying pipe 4, and a push button 12 which manipulates the open/close valve 6.

Further, the open/close valve 6 is mounted on one end portion of the water spraying pipe 4 which constitutes the water spraying portion 1*b*, and the shower head body 2 which constitutes the holding portion 1*a* is connected to the water spraying portion 1*b* while interposing the open/close valve 6 therebetween. On the other hand, the push button 12 is mounted on another end portion of the water spraying portion 1*b*. Further, a shaft 11 which is moved in an interlocking manner with the push button 12 is arranged in the inside of the water spraying portion 1*b* (water spraying pipe 4).

Further, the shaft 11 is interlockingly operated due to the manipulation of the push button 12 and the open/close operation of the open/close valve 6 is performed by way of the shaft 11.

The appearance of the shower nozzle 1 is explained in conjunction with FIG. 1.

The shower nozzle 1 is formed in an approximately I-type rod shape and also has an approximately cylindrical shape. Further, the shower nozzle 1 which is formed in the approximately rod shape in appearance is roughly divided into the holding portion 1*a* which a user holds with his/her hand and the water spraying portion 1*b* which forms the plurality of water passing holes 3 on the side surface thereof and jets water.

Still further, a shower hose 34 is connected to one end (lower end) of the shower nozzle 1 by way of a coupling 32, while the push button 12 which manipulates water jetting and water stopping through the water passing holes 3 is mounted on the other end (upper end) of the shower nozzle 1.

Here, an outer peripheral surface of the shower nozzle 1 is formed such that the nozzle body 1*c* which is constituted by connecting the holding portion 1*a* and the water spraying portion 1*b* is covered with an outer cover 17 to which the surface treatment such as plating is applied except for a water spraying region which forms the plurality of water passing holes 3 therein.

Further, an upper ring 13 and a lower ring 19 having diameters which are larger than an outer diameter of the shower nozzle 1 are mounted on an upper portion and a lower portion of the shower nozzle 1 in a state that the upper ring 13 and the lower ring 19 cover both end portions of the outer cover 17.

Next, the inner structure of the shower nozzle 1 is explained in conjunction with FIG. 2.

The shower nozzle 1 of the present invention is mainly constituted of the shower head body 2 which forms a hot/cold water inlet portion 2*a* at a lower end thereof, the water spraying pipe 4 which has the plurality of water passing holes 3 therein, the outer cover 17 which covers the shower head body 2 except for the water spraying region in which water passing holes 3 are formed, the push button 12, the open/close valve 6 which performs water jetting and water stopping with the push button 12, the upper ring 13 and the lower ring 19.

The specific structures of the respective constitutional parts and the mutual relationship among the respective constitutional parts are explained hereinafter.

The shower head body 2 has the approximately I-type columnar shape and is arranged in the inside of the holding portion 1*a* of the shower nozzle 1.

Further, at one end of the shower head body 2, the hot/cold water inlet portion 2*a* to which hot/cold water is supplied from a spout (not shown in the drawing) through the shower hose 34 (see FIG. 1) is provided, while at the other end of the shower head body 2, a thread portion 5 on which the water spraying pipe 4 is threadedly mounted by way of a packing 23 such as an O-ring is formed. That is, by integrally connecting the shower head body 2 and the water spraying pipe 4 by way of the thread portion 5, the nozzle body 1*c* having the rod-like approximately cylindrical shape which is constituted of the holding portion 1*a* and the water spraying portion 1*b* is formed. Then, the nozzle body 1*c* is covered with the outer cover 17 to which the surface treatment such as the plating is applied except for the portion (water spraying region) of the water spraying portion 1*b* of the nozzle body 1*c*.

The water spraying pipe 4 has I-type approximately cylindrical (approximately columnar) shape and forms the water spraying region where the plurality of water passing holes 3 are formed on a side surface thereof. Portions of the water spraying pipe 4 other than the water spraying region is covered with the outer cover 17 together with the shower head body 2 as described previously. Here, the water spraying pipe 4 is configured such that when the nozzle body 1*c* is covered with the outer cover 17 by mounting, a surface of the outer cover 17 and a surface of the water spraying region of the water spraying portion 1*b* become substantially coplanar with each other. Here, the passing holes 3 are formed in a plural number in the longitudinal direction in the inside of the water spraying region formed in the side surface of the water spraying pipe 4 (water spraying portion 1*b*).

Further, in the inside of the shower head body 2, the open/close valve 6 which controls water jetting and water stopping is mounted.

Figure 6:
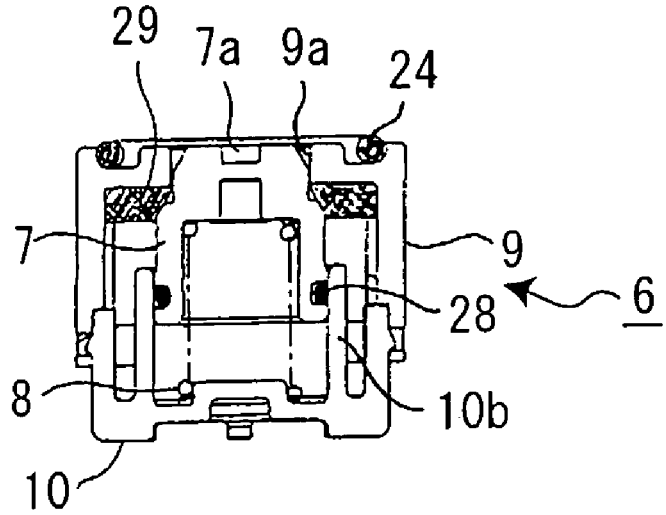
FIG. 6 is a cross-sectional view in the longitudinal direction of an open/close valve portion of the shower nozzle according to the embodiment of the present invention.

The open/close valve 6 is, as shown in FIG. 6, constituted of a main valve 7, a valve seat 29, a resilient body 8 such as a spring, a valve element 9, a cover 10 and packings 24, 28 formed of an O-ring.

Here, the specific constitution of the open/close valve 6 is further explained hereinafter.

In the open/close valve 6, by engaging and joining the valve element 9 and the cover 10, an outer shell (an external shape) of the open/close valve 6 having an approximately cylindrical shape is formed. The valve seat 29 is formed on the valve element 9 and a water passing opening 9*a* is formed at the center of the valve seat 29.

Further, the main valve 7 is arranged slidably in the axial direction in the inside of the open/close valve 6 such that the main valve 7 is seated on or separated from the valve seat so as to open or close the water passing opening 9*a* while being biased in the seating direction due to the resilient body 8 such as the spring. That is, the main valve 7 is biased in the direction toward the water spraying pipe 4 direction (that is, the downstream direction) due to the resilient body 8 such as the spring so as to stop water by seating on the valve seat 29 of the valve element 9.

That is, a slide guide 10*b* is formed in the inside of the cover 10, the main valve 7 is mounted in the slide guide 10*b* while interposing a packing 28 such as an O-ring or the like therebetween, and the resilient body 8 such as the spring is arranged between the slide guide 10*b* and the main valve 7. Here, the water passing opening 10*a* is formed in the cover 10 (see FIG. 8).

Further, the open/close valve 6 is mounted in the inside of the thread portion 5 side of the shower head body 2 byway of the packing 24 such as the O-ring and, thereafter, is fixed to the inside of the shower head body 2 by threadedly engaging the water spraying pipe 4 with the thread portion 5.

Here, in such an operation, the open/close valve 6 is arranged in the inside of the shower head body 2 such that the open/close valve 6 assumes the arrangement and the posture in which the valve element 9 is positioned on the water-spraying-pipe-4-side and the cover 10 is positioned on the shower head body 2 (facing the hot/cold water inlet portion 2*a* side).

Next, the inner structure for manipulating the opening and closing of the open/close valve 6 using the push button 12 is explained in conjunction with FIG. 2.

As parts which assists the operation of the open/close valve 6, a shaft 11 which transmits the vertical movement of the push button 12 to the open/close valve 6 is arranged in the inside of the shower nozzle 1 in a state that the shaft 11 penetrates the water spraying pipe 4 and the shaft guide 25. Here, in FIG. 2, numeral 25 indicates a shaft guide and the shaft guide 25 is mounted on an end portion of the water spraying pipe 4 by way of a packing 25*a* such as an O-ring. Further, the push button 12 is mounted in the axial direction of the shaft guide 25 by way of a packing 27 such as an O-ring and a washer 13*c*.

Further, the shaft 11 is arranged to be interlocked in series with the push button 12 which is arranged in the inside of the shaft guide 25. Still further, as shown in FIG. 6, a recessed portion 7*a* is formed in the main valve 7 of the open/close valve 6 and a distal end (lower end) of the shaft 11 is inserted into the recessed portion 7*a*.

Due to such a constitution, by manipulating the push button 12, it is possible to operate the open/close valve 6 by way of the shaft 11 so as to open or close the open/close valve 6.

Figure 8:
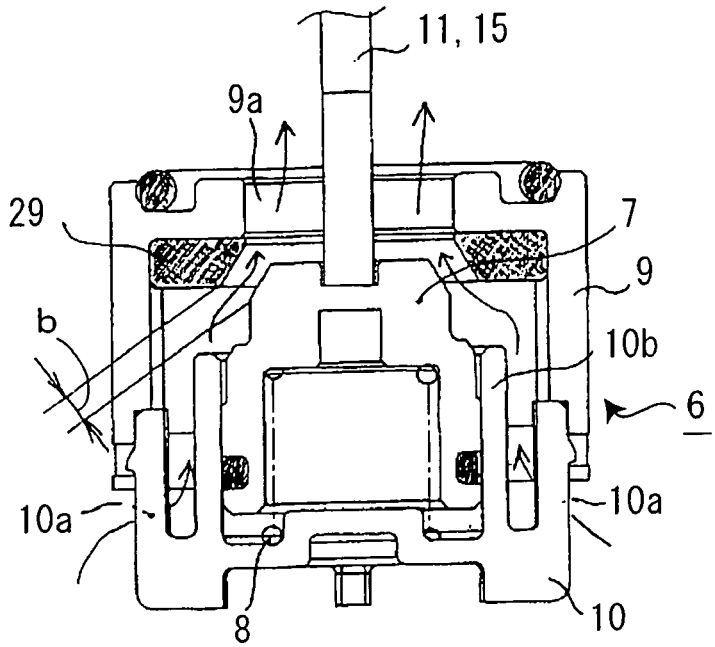
FIG. 8 is a cross-sectional view of a valve portion in an open state according to the embodiment of the present invention.
Figure 14:
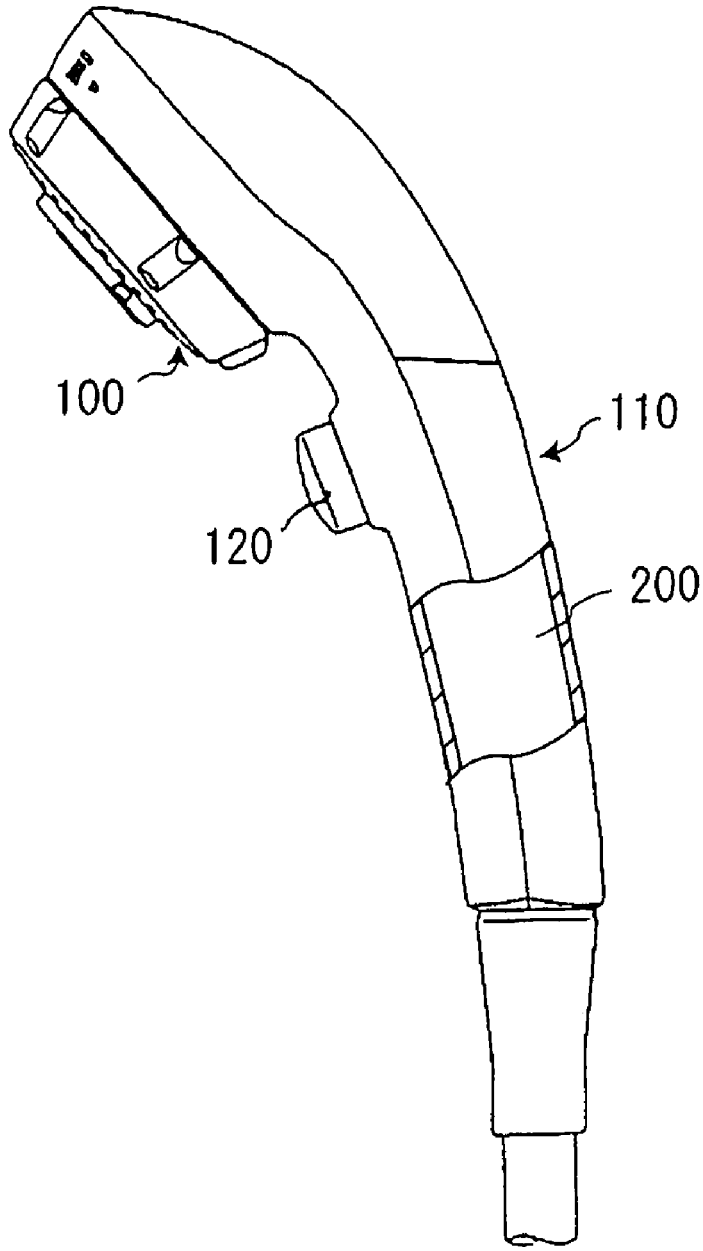
Fig. 14 RELATED ART
FIG. 14 is an appearance view showing a portion of a conventional shower nozzle which forms a push button in a holing portion in a cross-sectional view.

That is, when the push button 12 is pushed, the shaft 11 which is interlocked with the push button 12 pushes down the main valve 7 against the biasing force of the resilient body 8 so that, as shown in FIG. 8, the water passing opening 9*a* is opened whereby the shower jetting is performed through the water passing holes 3. At this point of time, the push button 12 is locked and hence, the water passing state can be maintained. Here, the lock mechanism adopts the well-known constitution similar to a lock mechanism of the push button which is used also in the conventional shower nozzle shown in FIG. 14 and hence, detailed views of FIG. 2 and FIG. 3 and the explanation of the detailed views are omitted.

Figure 9:
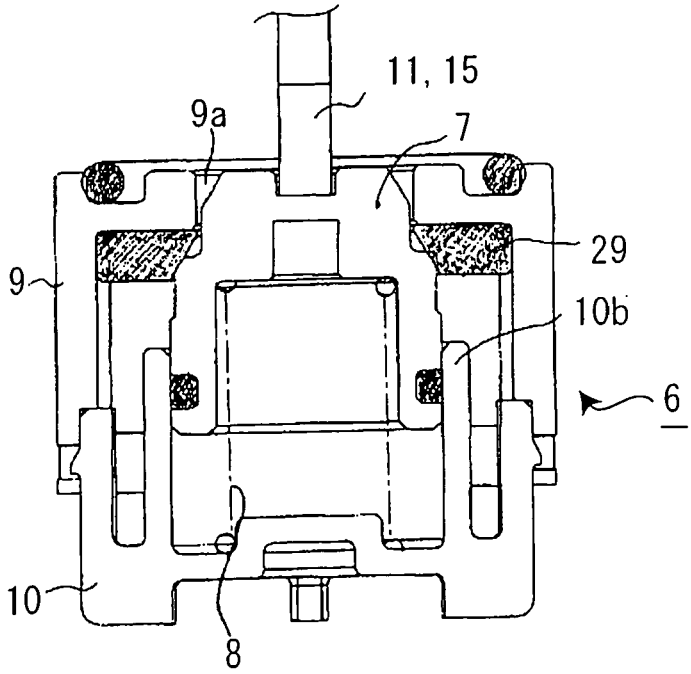
FIG. 9 is a cross-sectional view of the valve portion in a closed state according to the embodiment of the present invention.

Then, when the push button 12 is pushed again, the locking of the push button 12 is released and, due to a restoring force of the resilient body 8, as shown in FIG. 9, the main valve 7 is biased and is seated on the valve seat 29 so as to close the water passing opening 9*a* thus stopping the shower jetting through the water passing holes 3.

In the shower nozzle 1 according to this embodiment, by arranging the push button 12 coaxially with and above the shower head body 2 (shower nozzle 1), user can open or close the open/close valve 6 with the manipulation of the push button 12 by pushing the push button to each part of his/her body or an object around the shower nozzle 1 whereby the manipulation method can be expanded.

Figure 10:
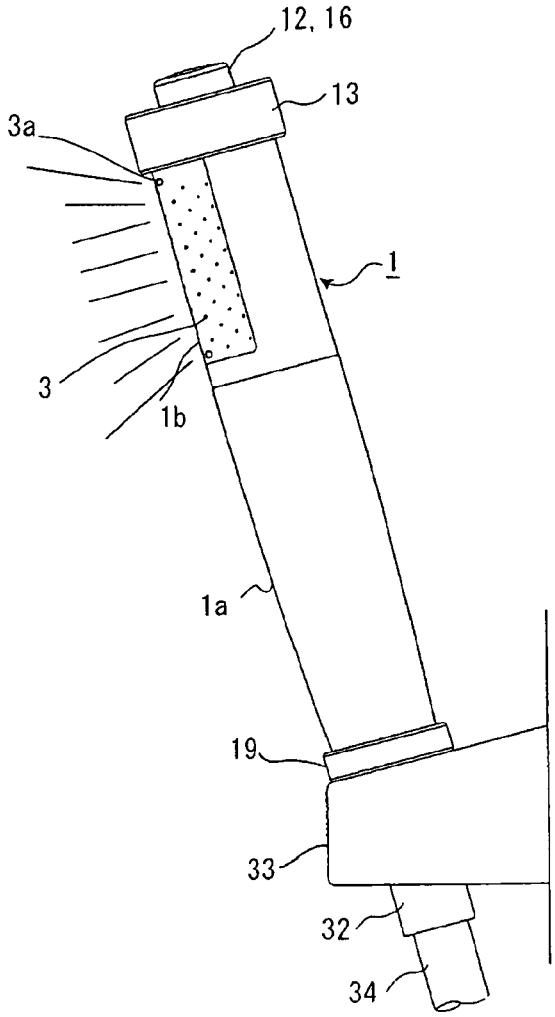
FIG. 10 is an explanatory view showing a state in which the water jetting is performed with the shower nozzle according to the embodiment of the present invention being engaged with a shower hook.
Figure 10:
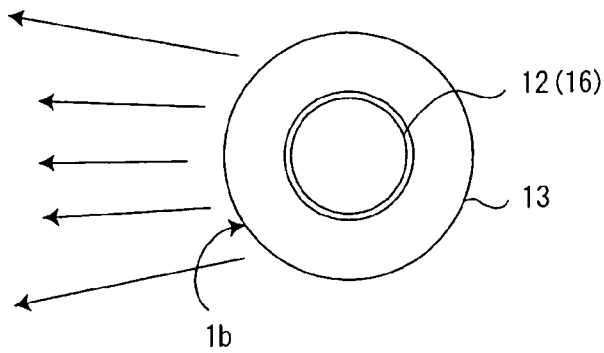

Further, as shown in FIG. 10(*a*), when the shower jetting is performed by engaging the shower nozzle 1 with the shower hook 33, the user can perform water jetting and water stopping by pushing the push button 12 which is positioned on the upper end portion of the shower nozzle 1 from above. Accordingly, the operability of the shower nozzle 1 is extremely enhanced. Further, to push the push button 12 from above implies to push the push button 12 in the direction at which the shower nozzle 1 is firmly held by the shower hook 33 and hence, when the push button 12 is manipulated, there is no possibility that the shower nozzle 1 is removed from the shower hook 33. Further, since it is enough to push the push button 12 from above, there is no possibility that the holding direction is changed and hence, the water spraying direction is also changed.

Here, the coupling 32 which is connected with the shower hose 34 and is engaged with the shower hook 33 is provided to the holding portion 1*a*. Further, the lower ring 19 is formed between the coupling 32 and the holding portion 1*a*. Accordingly, when the user pushes the push button 12 in a state that the shower nozzle 1 is held by the shower hook 33, the pushing force acts in the direction to further increase the holding force. However, since the lower ring 19 comes into contact with an upper end of the shower hook 33, there is no possibility that the pushing force becomes equal to or more than a given holding force. That is, there is no fear that the shower nozzle 1 is fitted into the shower hook 33 to an extent the shower nozzle 1 is not removed from the shower hook 33.

Figure 3:
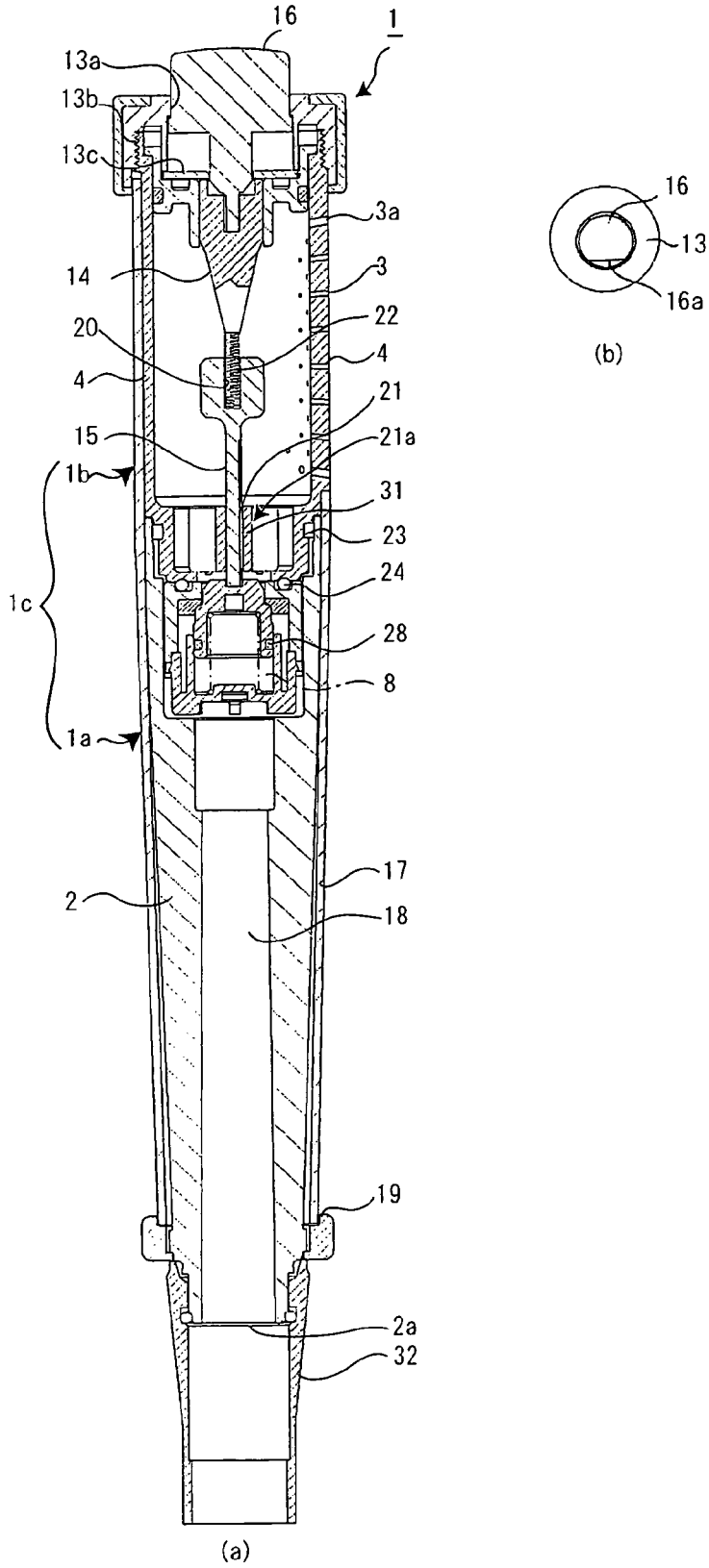
FIG. 3 is a cross-sectional view in the longitudinal direction of the shower nozzle according to another embodiment of the present invention.

Further, the explanation is made with respect to an embodiment which is provided with not only the open/close manipulation of water jetting and water stopping but also flow rate adjusting function in conjunction with FIG. 3. Here, the explanation is omitted with respect to the constitution similar to the constitution shown in FIG. 2.

As shown in FIG. 3, the shower nozzle 1 of this embodiment has the structure which enables the flow rate adjustment by constituting the shaft 11 using two parts. That is, the shaft 11 shown in FIG. 2 is constituted of an upper shaft 14 and a lower shaft 15 as shown in FIG. 3.

To be more specific, a thread portion 20 is formed on one side which constitutes an upper end of the lower shaft 15 which is arranged on the open/close-valve-6-side and, at the same time, a thread portion 22 which is threadedly engaged with the thread portion 20 of the lower shaft 15 is formed on an upper shaft 14 which is arranged on a push-button-16-side.

Further, a longitudinal slit 21 is formed in the lower shaft 15 and a projection (not shown in the drawing) which is formed in a projecting manner on a guide portion 31 provided in the vicinity of the open/close valve 6 is fitted into the slit 21 with a play thus forming a rotation restricting portion 21*a*, whereby the lower shaft 15 is arranged to slide along the guide portion 31 without being rotated.

Further, the push button 16 has the structure which allows the horizontal rotation as well as the vertical movement.

FIG. 3(B) shows a plan view in a reduced size of the shower nozzle 1 shown in FIG. 3(A) as viewed from the push-button-16-side. In this manner, a distal end portion of the push button 16 is, as shown in FIG. 3(B), not formed in a circular shape in a plan view but has an arcuate portion thereof cut (a cut portion indicated by numeral 16*a*) to form a D shape in a plan view. Due to such a constitution, a user's finger easily catches the push button 16 so that the user can easily rotate the push button 16. Further, due to the combination of the push button 16 with the upper shaft 15, it is possible to transmit the rotational movement to the upper shaft 15 so as to enable the flow rate adjustment.

Figure 4:
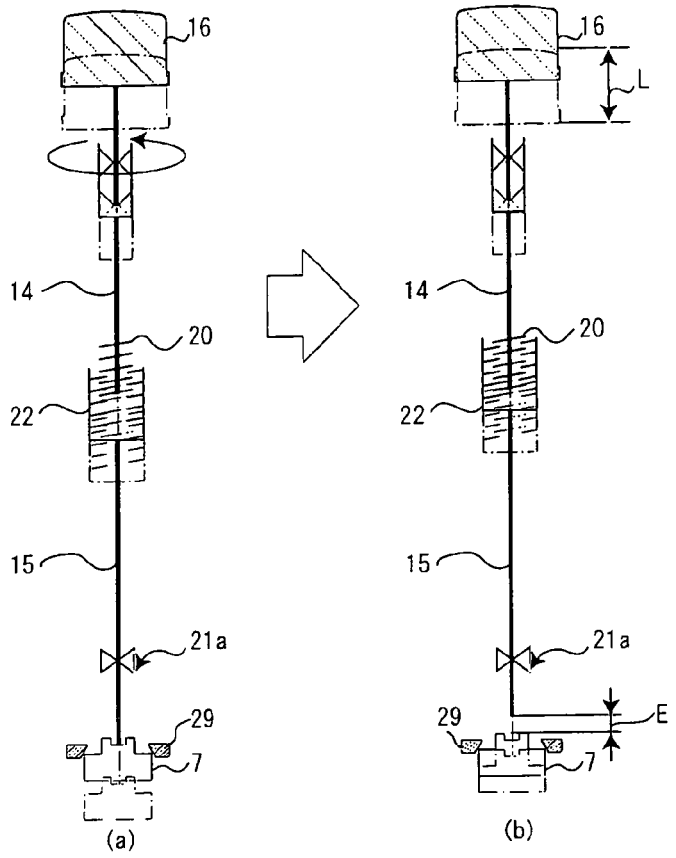
FIG. 4 is a schematic explanatory view of the shower nozzle according to the another embodiment.

That is, as show in FIG. 4, when the push button 16 is rotated, only the upper shaft 14 is rotated (the lower shaft 15 being not rotatable due to the rotation restricting portion 21 a having the slit 21), the thread portions 20, 22 are engaged in the thread rotation. Accordingly, the lower shaft 15 is advanced or retracted in the vertical direction and hence, the distance E which constitutes a play between the distal end of the lower shaft 15 and the main valve 7 is changed whereby, the distance which the shaft 11 pushes the main valve 7 as a whole can be adjusted. Here, among the vertical movement distance L of the push button 16, the distance E which constitutes the play and the degree of opening E' of the main valve 7, a following relationship is established.

$$L-E_{max} \leqq E' \leqq L-E_{min}$$

That is, when the push button 16 is pushed, the main valve 7 is locked in an open state and, thereafter, the push button 16 is rotated, as shown in FIG. 8, the full length of the shaft 11 (the upper shaft 14, the lower shaft 15) is shrunken and hence, an opening area b which depends on the position of the valve element 7 can be changed whereby a jetting water quantity can be adjusted.

Figure 5:
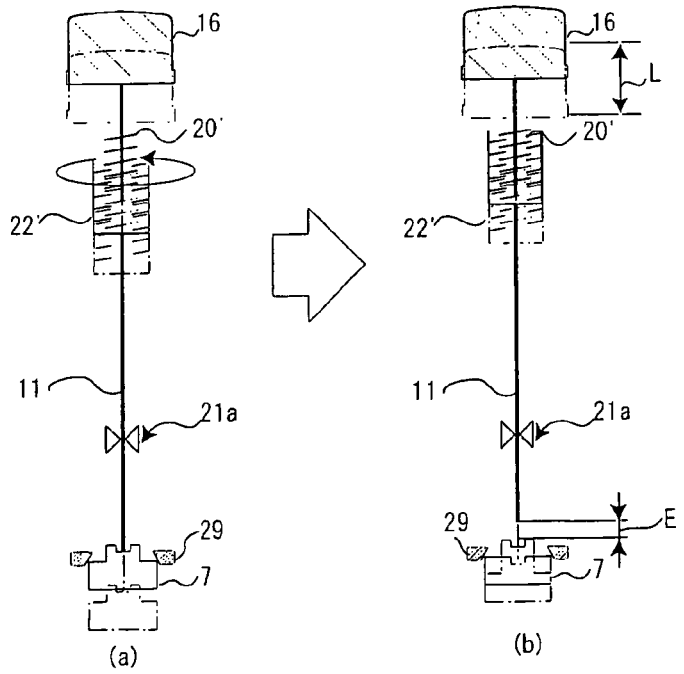
FIG. 5 is a schematic explanatory view showing a modification of the another embodiment.

Further, the flow rate adjusting function attributed to the rotation of the push button 16 may be obtained by the constitution shown in FIG. 5.

That is, to be more specific, as shown in FIG. 5, one shaft 11 is used and an upper end portion of the shaft 11 and a lower end portion of the push button 16 are threadedly engaged with each other. Here, a thread portion 20' is formed on one side which constitutes the upper end of the shaft 11 and, at the same time, a thread portion 22' which is threadedly engageable with the thread portion 20' is formed on the lower end of the push button 16 in a projecting manner. Here, the shaft 11 s also provided with the rotation restricting portion 21*a*.

Then, also with such a constitution, among the vertical movement distance L of the push button 16, the distance D which constitutes the play and the degree of opening L' of the main valve 7, the formula is established.

Next, the outer cover 17 is explained.

As mentioned previously, on the outer peripheral portions of the water spraying pipe 4 and the shower head body 2 which are threadedly engaged with each other to constitute the nozzle body 1*c*, the outer cover 17 is mounted such that the outer cover 17 covers the whole outer peripheral portions except for the water spraying region where the water passing holes 3 are formed.

Here, the outer cover 17 is formed of a material to which the plating or the coating can be applied. Further, by applying colors to the outer cover 17, it is possible to enhance the design.

Particularly, by detachably mounting the outer cover 17 to which the plating or the coating is applied as a separate body as in the case of the present invention, it is possible to select the color of the appearance at a low cost depending on a taste of the user.

Further, since the outer cover 17 to which the plating or the coating is applied is constituted as the separate body from the water flow passage 18 of the shower nozzle 1 and hence, a step for preventing the adhesion of plating and coating to the water flow passage 18 by providing a plating adhering prevention lid for masking or by applying a masking agent or a step for removing the adhered plating or coating which has been carried out conventionally becomes no more necessary and hence, the parts can be manufactured at a low cost.

Further, it is also possible to provide an air layer between the water flow passage 18 and the outer cover 17. This constitution has an advantage that the heat insulation effect is obtainable.

Further, to protect end portions of the outer cover 17, the upper ring 13 and the lower ring 19 are provided to upper and lower end portions of the shower nozzle.

The shapes of the upper ring 13 and the lower ring 19 are, since these rings 13, 19 are mainly provided for protecting the outer cover 17, formed in approximately short cylindrical shapes (approximately columnar shapes) having diameters which are larger than a diameter of the outer cover 17 to allow the rings 13, 19 to bulge outwardly from an outer periphery of the outer cover 17 in a state that the rings 13, 19 are mounted on the outer cover 17.

With respect to the upper ring 13 which is mounted on an upper side of the shower nozzle 1, to hold the members which constitute the push button 12, 16 thus preventing the members from being removed, a thread portion 13*b* which is threadedly engaged with an upper end portion of the water spraying pipe 4 is formed. Further, to absorb an impact when the shower nozzle 1 falls down, at least an outer portion of the upper ring 13 is preferably covered with a soft material. Here, in FIG. 2, numeral 13*a* indicates insertion holes which penetrate the push buttons 12, 16.

On the other hand, the lower ring 19 which is mounted on the lower side of the shower nozzle 1 is provided for protecting as well as for holding an end portion of the outer cover 17.

Although it is preferable that an outer appearance portion of the lower ring 19 is formed of a soft material, the outer appearance portion may be formed of a hard material. This is because that since the lower ring 19 side is connected with the shower hose 34, when the shower nozzle 1 falls down by an accident, there is substantially no possibility that the lower ring 19 impinges on a floor.

Figure 7:
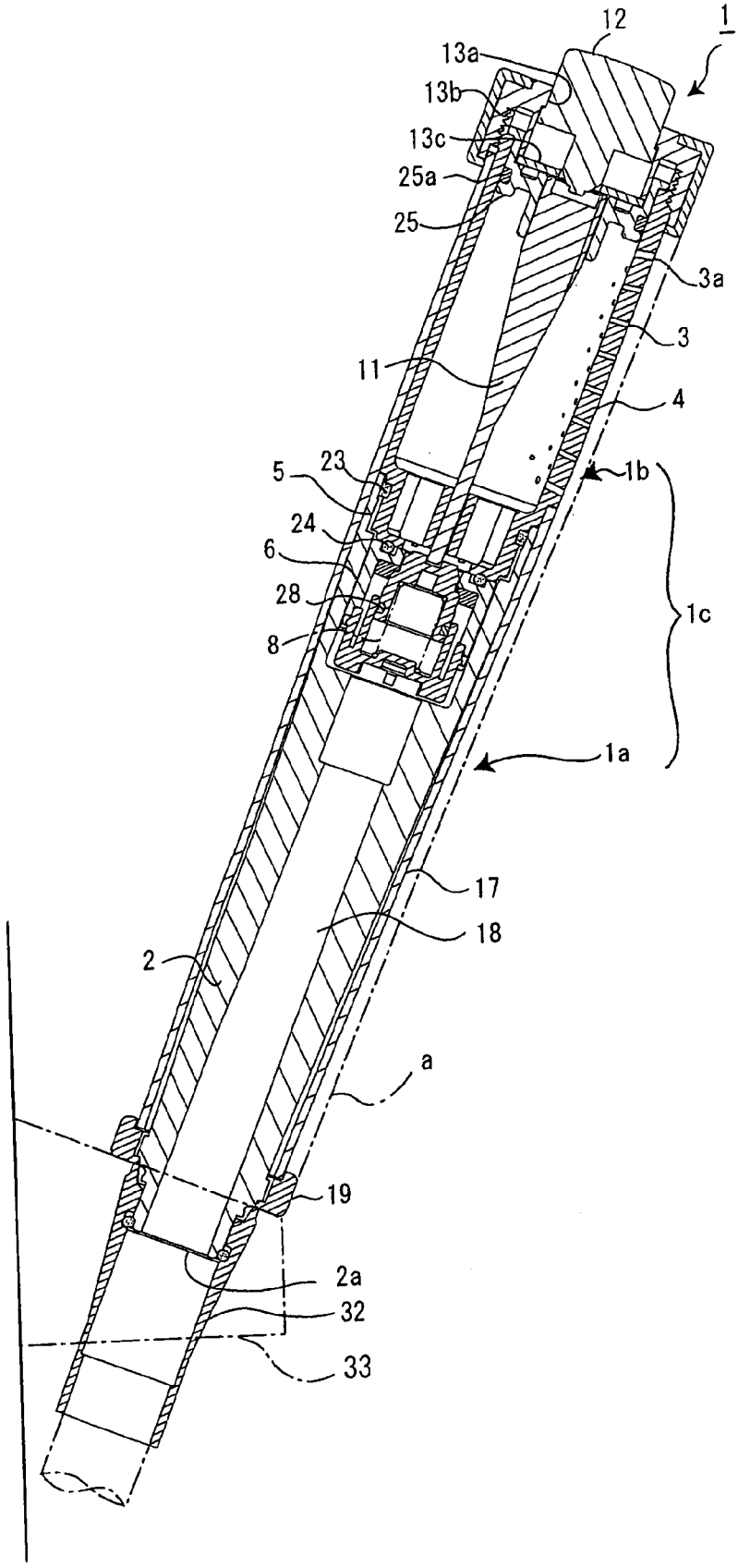
FIG. 7 is a cross-sectional view in the longitudinal direction of the shower nozzle according to the embodiment of the present invention.

Here, both rings 13, 19 are provided for preventing surfaces of the outer cover 17 from being brought into contact with tile surfaces of a floor and being damaged when the shower nozzle 1 falls down. Accordingly, as shown in FIG. 7, it is necessary to determine the sizes and the shapes of both rings 13, 19 and the outer cover 17 such that the outer periphery of the outer cover 17 falls in the inside of a line "a" which connects an outre periphery of the upper ring 13 and an outer periphery of the lower ring 19.

Here, the shower nozzle 1 of the present invention which has been explained heretofore may be also configured as follows. That is, the push buttons 12, 16 are detachably mounted. Further, the upper ring 13 which forms the insertion hole 13*a* which allows the insertion of the push buttons 12, 16 therein and an upper cap 40 which is capable of sealing water without allowing the push buttons 12, 16 to pass therethrough can be selectively mounted on the upper end of the water spraying portion 1*b*.

Here, the open/close valve 6 which is opened and closed due to the manipulation of the push button 12, 16 is detachably mounted. Further, it is needless to say that the diameters of the upper ring 13 and the upper cap 40 are set larger than the profile of the nozzle body 1*c*.

That is, after removing the upper ring 13, the push button 12, 16 is removed. At the same time, the open/close valve 6 and the shaft 11 (including the upper shaft 14 and the lower shaft 16) which are constitutional elements relevant to the push button 12, 16 are taken out from the nozzle body 1*c* and the upper cap 40 is mounted in place of the upper ring 13. Then, as shown in FIG. 11, it is possible to assemble the I-type rod-like shower nozzle 1' in which the water flow passage 18 and the water passing holes 3 are directly communicated with each other.

In this manner, it is possible to extremely easily change the manner of using the shower nozzle between the shower nozzle 1 which can perform water stopping and water jetting using the push button 12, 16 and the shower nozzle 1' which is not provided with the push button 12, 16.

To consider this constitution from the manufacturer's side, since all parts are parts which are used in common, it is possible to provide two kinds of shower nozzles 1, 1' which differ in function at a low cost. On the other hand, to consider this constitution from the user's side, for example, when the user has already purchased the shower nozzle 1 having the water jetting/stopping changeover function using the push button 12, 16, for example, the user can make use of the shower nozzle 1 as the usual shower nozzle 1' by merely purchasing the upper cap 40. Further, also in an opposite case, by purchasing the parts such as the push button 12 (16), the shaft 11 (the upper shaft 14, the lower shaft 15), the open/close valve 6 and the like and by mounting these parts to the shower nozzle 1' later, it is possible to use the usual shower nozzle 1' as the shower nozzle 1 having the water jetting/stopping changeover function using the push button 12, 16.

Figure 11:
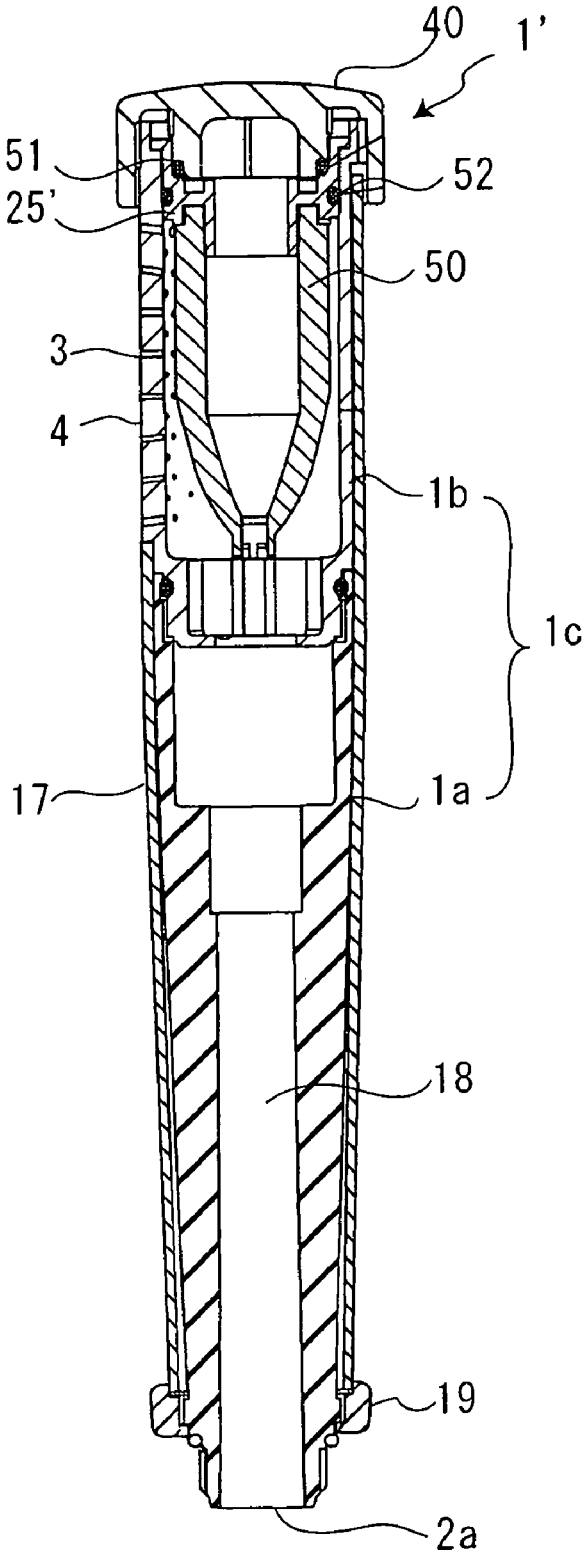
FIG. 11 is a cross-sectional view in the longitudinal direction of a shower nozzle according to another embodiment in a state that a push button is removed.
Figure 12:
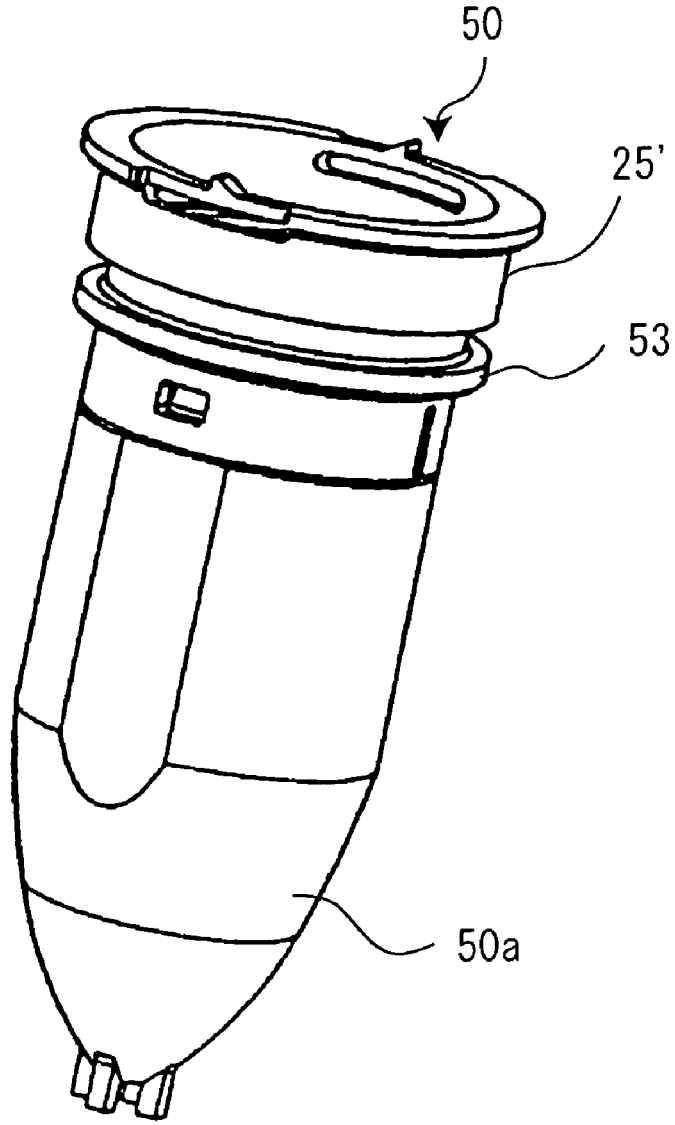
FIG. 12 is a perspective view of a volume reducing unit which is used in another embodiment of the present invention.
Figure 13:
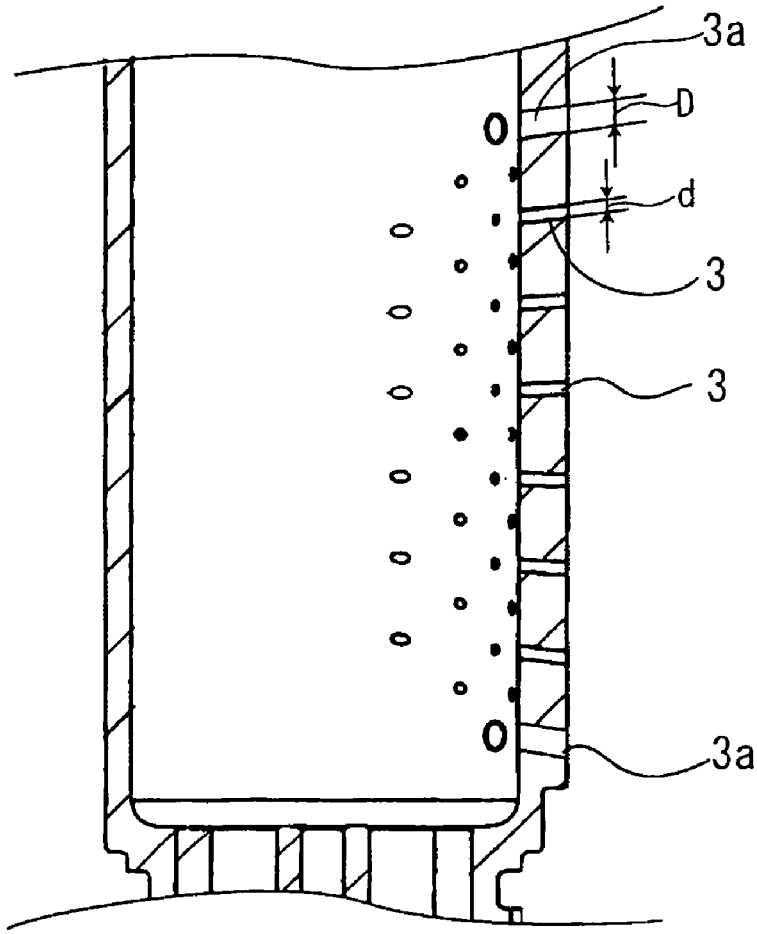
FIG. 13 is a cross-sectional view in the longitudinal direction which omits a portion of the water spraying portion of the shower nozzle according to the embodiment of the present invention.

Next, in conjunction with FIG. 11 to FIG. 13, the explanation is made with respect to a volume reducing body 50 which constitutes a volume reducing unit housed in the inside of the water spraying pipe 4 of the water spraying portion 1*b* and the water passing holes 3 formed in the water spraying pipe 4 in the shower nozzle 1' having no water stopping/water jetting changeover function.

All of these parts are provided for preventing the dripping of water staying in the inside of the water spraying pipe 4 from dripping through the water passing holes 3 when the shower nozzle 1' is engaged with the shower hook 33.

That is, in a conventional shower nozzle (see FIG. 14), when the shower nozzle is engaged with a shower hook, the water spraying portion 100 assumes an oblique posture. Accordingly, in general, a mesh is arranged in the vicinity of the water passing hole to apply a surface tension on openings of the mesh thus preventing the flowing out of the staying water. The shower nozzle 1' of the present invention is engaged with the shower hook 33 in a substantially vertical state and hence, it is difficult to apply the surface tension. Accordingly, the shower nozzle 1' of the present invention is configured to cope with the staying water in the inside of the water spraying pipe 4 by quickly allowing the staying water to flow out faster.

For this end, as shown in FIG. 11 and FIG. 12, the volume reducing body 50 which has a diameter slightly smaller than an inner diameter of the water spraying pipe 4 and has a lower cylindrical portion thereof formed in a curved shape by gradually narrowing the diameter is housed in the inside of the water spraying pipe 4 thus reducing the substantial volume of the water spraying pipe 4.

In this manner, by housing the volume reducing body 50 in the inside of the shower nozzle 1', water which flows into the inside of the water spraying pipe 4 from the water flow passage 18 smoothly flows along a curved lower portion 50*a* of the volume reducing body 50, flows into a narrow gap between an inner wall of the water spraying pipe 4 and the volume reducing body 50 and is vigorously jetted from the water passing holes 3. On the other hand, when the shower nozzle 1' is engaged with the shower hook 33 in a substantially vertical state after water stopping, since the volume inside the water spraying pipe 4 per se is reduced due to the presence of the volume reducing body 50, a staying water amount is small and hence, a flow-out time of the staying water from the water passing holes 3 is largely shortened thus enhancing the draining of water. Here, in FIG. 11, numerals 51, 52 indicate packings and numeral 25' indicates a guide which is arranged at an upper end portion of the water spraying pipe 4 in a state that these parts are positioned between the upper cap 40 and the volume reducing body 50. These parts can stably hold the volume reducing body 50 by pressing the volume reducing body 50. Further, in FIG. 12, numeral 53 indicates a groove for arranging packing.

Further, according to this embodiment, as shown in FIG. 13, among the plurality of water passing holes 3, a diameter D of the water passing holes 3 which are positioned at an upper most portion and a lowermost portion of the water spraying pipe 4 is set larger than a diameter d of other water passing holes 3.

That is, by setting the diameter of the water passing holes 3 positioned at the uppermost portion and the lowermost portion of the water spraying pipe 4 larger than the diameter of the other water passing holes 3*a*, air is introduced into the inside of the water spraying portion 1*b* through the water passing holes 3*a* at the uppermost portion of the water spraying pipe 4 and hence, it is possible to make the staying water in the inside of the water spraying pipe 4 flow out more speedily.

In this manner, by housing the volume reducing body 50 in the inside of the water spraying pipe 4 and, at the same time, by setting the diameter of the water passing holes 3*a* positioned as the uppermost portion and the lowermost portion of the water spraying pipe 4 larger than the diameter of the other water passing holes 3, it is possible to perform the draining of the staying water in the inside of the water spraying portion 1*b* more speedily whereby when the shower nozzle 1' is engaged with the shower hook 33, it is possible to prevent the staying water from dripping continuously through the water passing holes 3, 3*a* drop by drop.

Further, as shown in FIG. 10(*a*), to allow the shower jetting from the water spraying portion 1*b* to spread in the upward and downward directions, the respective water passing holes 3 are formed such that these water passing holes 3 penetrate a peripheral wall of the water spraying portion 1*b* obliquely. It is needless to say that since the water spraying portion 1*b* is formed in an approximately cylindrical shape, as shown in FIG. 10(*b*), the shower jetting spreads frontwardly and hence, a shower range is broadened. In this manner, the shower nozzle 1(1') according to this embodiment can broaden the shower range which covers the user's body and hence, the user can enjoy the comfortable shower.

Although in the explanation which has been made with respect to the embodiments, the example in which the shaft 11 which is moved in an interlocking manner with the push button 12 is arranged in the inside of the water flow passage 18 of the water spraying portion 1*b* is described. However, the shaft 11 is not always arranged in the inside of the water flow passage 18. For example, using the volume reducing body 50 shown in FIG. 11, another space which may be partitioned from the water flow passage may be formed in the water spraying portion 1*b* in the axial direction, and the shaft 11 may be arranged in the inside of this another space partitioned from the water flow passage, that is, in the inside of the volume reducing body 50.

INDUSTRIAL APPLICABILITY

According to the present invention, it is possible to provide the shower nozzle, wherein the holding portion having the water flow passage communicating with the hot/cold water inlet formed therein and the water spraying portion having the plurality of water passing holes provided therein are connected to each other through the open/close valve detachably disposed at one end portion of the holding portion or the water spraying portion to form the nozzle body, the push button is mounted on the other end of the water spraying portion, the shaft which performs the open/close operation of the open/close valve in an interlocking manner with the push button is arranged in the inside of the water spraying portion and, the shaft is vertically movable in an interlocking manner with the vertical movement generated by pushing the push button and with the rotational movement which is generated by the rotation of the push button, and hence, the degree of opening of the open/close valve is adjustable, whereby the push button for performing water jetting and water stopping can be easily manipulated in the state of the shower nozzle engaged with the shower hook thus enhancing the easy-to-use property of the shower nozzle.

Further, with the provision of the flow rate adjusting function, it is possible to provide the shower nozzle which can further enhance the easy-to-use property thereof.

Still further, by detachably mounting the push button and the open/close valve, the shower nozzle can be easily converted into a type not having a water jetting and stopping function or a type having the water jetting and stopping function.

Still further, by detachably covering the portion of the nozzle body except for at least the water passing holes with the cover to which the surface treatment is applied and which constitutes the separate body, it is possible to provide the high-quality shower nozzle which has the erosion resistance, the excellent design and to which the surface treatment is applied at a low cost. Further, by forming the ring having the diameter larger than the diameter of the nozzle body on the upper end of the nozzle body, there is no fear that the portion to which the surface treatment is applied is damaged.

The invention claimed is:

1. A shower nozzle, comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein the shaft is constituted of an upper shaft arranged on the push button side, a lower shaft arranged on the open/close valve side, and end portions of the upper shaft and lower shaft are threadedly engaged with each other.

2. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein the push button and the valve are detachably mounted, and wherein an upper end portion of the shaft and a lower end portion of the push button are threadedly engaged with each other.

3. A shower nozzle according to claim 2, wherein the spraying portion is adapted to detachably mount an upper cap in place of the valve and the push button.

4. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein an upper end portion of the shaft and a lower end portion of the push button are threadedly engaged with each other.

5. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein the push button and the valve are detachably mounted, and wherein the shaft is constituted of an upper shaft arranged on the push button side and a lower shaft arranged on the open/close valve side and, end portions of the upper shaft and lower shaft are threadedly engaged with each other.

6. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein a nozzle body is comprised of the holding portion, the water, spraying portion and the open/close valve, and wherein a portion of the nozzle body except for at least the water passing holes is covered with a detachable cover to which a surface treatment is applied and which also constitutes a separate body.

7. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein with respect to the plurality of water passing holes formed in the water spraying portion, the water passing holes which are positioned at an uppermost portion and a lowermost portion of the water spraying portion are formed to have a diameter larger than a diameter of other water passing holes.

8. A shower nozzle comprising:

a holding Portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button. Whereby a degree of opening of the open/close valve is adjustable.

wherein in the inside of the water spraying portion, a volume reducing unit which reduces a volume in which a staying water to be communicated with the water spraying holes stays when the shower nozzle is arranged vertically.

9. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein the push button and the open/close valve are detachably mounted, wherein a nozzle body is comprised of the holding portion, the water, spraying portion and the open/close valve, and wherein a portion of the nozzle body except for at least the water passing holes is covered with a detachable cover to which a surface treatment is applied and which also constitutes a separate body.

10. A shower nozzle comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein the push button and the open/close valve are detachably mounted, and wherein with respect to the water passing holes formed in the water spraying portion, the water passing holes which are positioned at an uppermost portion and a lowermost portion of the water spraying portion are formed to have a diameter larger than a diameter of other water passing holes.

11. A shower nozzle, comprising:

a holding portion defining a water flow passage having an inlet;

a water spraying portion including water passing holes;

an open/close valve fluidly connecting the holding portion to a first end of the water spraying portion, said valve being detachably disposed at the first end portion of the holding portion or an end of the water spraying portion;

a push button mounted on the second end of the water spraying portion; and a shaft interlocked with the push button and being disposed in an interior of the water spraying portion, axial movement of the shaft being caused by pushing the push button and rotational movement of the push button, whereby a degree of opening of the open/close valve is adjustable, wherein the push button and the open/close valve are detachably mounted, and wherein in the inside of the water spraying portion, a volume reducing unit which reduces a volume in which a staying water to be communicated with the water spraying holes stays when the shower nozzle is arranged vertically.

12. A shower nozzle according to claim 5, 9, 10 or 11 wherein the spraying portion is adapted to mount an upper cap in place of the valve and the push button.

* * * * *